US010722911B2

(12) United States Patent
Surin et al.

(10) Patent No.: US 10,722,911 B2
(45) Date of Patent: Jul. 28, 2020

(54) MOUNTING AND DISMOUNTING OF A PUMP WITH RESPECT TO THE RESERVOIR

(71) Applicant: ALBEA SERVICES, Gennevilliers (FR)

(72) Inventors: Charles Surin, Chardonnay (FR); Sylvain Theroude, Vignoles (FR)

(73) Assignee: ALBEA SERVICES, Gennevilliers (FR)

( * ) Notice: Subject to any disclaimer, the term of this patent is extended or adjusted under 35 U.S.C. 154(b) by 0 days.

(21) Appl. No.: 16/529,665

(22) Filed: Aug. 1, 2019

(65) Prior Publication Data

US 2020/0061650 A1 Feb. 27, 2020

(30) Foreign Application Priority Data

Aug. 1, 2018 (FR) ..... 18 57226

(51) Int. Cl.
*B05B 11/00* (2006.01)
*B65D 50/04* (2006.01)

(52) U.S. Cl.
CPC ..... *B05B 11/3049* (2013.01); *B05B 11/001* (2013.01); *B65D 50/046* (2013.01)

(58) Field of Classification Search
CPC .. B05B 11/3049; B05B 11/001; B65D 50/046
USPC ..... 222/153.09
See application file for complete search history.

(56) References Cited

U.S. PATENT DOCUMENTS

| | | | |
|---|---|---|---|
| 5,938,082 | A | 8/1999 | Foster et al. |
| 6,155,462 | A | 12/2000 | Brecheisen et al. |
| 2009/0152303 | A1 | 6/2009 | Behar et al. |
| 2012/0318825 | A1 | 12/2012 | Beranger et al. |

FOREIGN PATENT DOCUMENTS

| | | |
|---|---|---|
| DE | 8702986 | 4/1987 |
| WO | WO2012092989 | 7/2012 |

*Primary Examiner* — Patrick M. Buechner
*Assistant Examiner* — Michael J. Melaragno
(74) *Attorney, Agent, or Firm* — Steven M. Greenberg, Esq.; Shutts & Bowen LLP

(57) ABSTRACT

A dispensing unit for dispensing a fluid product includes a reservoir for packaging the product, that has a body surmounted by a neck defining an upper opening, a system for dispensing the product, and a device for fixing the dispensing system to the reservoir. The fixing device consists of one single part having securing means on the neck of the reservoir actuated by an axial translational movement and disconnection means with respect to the neck of the reservoir actuated by a rotational movement.

13 Claims, 4 Drawing Sheets

MOUNTING AND DISMOUNTING OF A PUMP WITH RESPECT TO THE RESERVOIR

CROSS REFERENCE TO RELATED APPLICATIONS

This application claims priority under 35 U.S.C. § 119(a) to COUNTRY patent application 1857226, filed Aug. 1, 2018, the entire teachings of which are incorporated herein by reference.

BACKGROUND OF THE INVENTION

Field of the Invention

The invention relates to a unit for dispensing a fluid product, with a reservoir containing the fluid product, and a device for fixing a dispensing pump on the neck of the reservoir. This invention also relates to a method for the improved mounting and dismounting of the pump with respect to the reservoir.

Description of the Related Art

Dispensing units including a reservoir for packaging the product are known, formed by a body surmounted on a neck defining an upper opening for the reservoir and a pump mounted in the upper opening by arranging the means for supplying the pump inside the reservoir. Thus, the pump makes it possible to return the packaged product into the reservoir.

To ensure the positioning and fixing of the pump with respect to the body, a system including a sleeve having means for fastening the pump and a skirt provided with means for fixing the sleeve on the reservoir can be used.

The fixing system further includes a cap mounted sliding around the skirt between a high position, in which the fastening means are free so as to make it possible for the positioning the skirt around the neck and a low position in which the fastening means are stressed by the cap to ensure the sealed fixing of the sleeve on the neck of the reservoir.

The problem posed with using such systems according to the prior art is that the fixing of the pump is immovable. Yet, for ecological problems with the end-of-life recycling of the vial, it is current practice to facilitate the separation of the pump mainly constituted of plastic and metal materials, from the reservoir often made of a different plastic material category or made of glass.

To resolve this problem, using sleeves which are mounted by screwing on the threaded neck is known. However, perfumers, cosmeticians or chemists do not generally want the sleeves to be unscrewable and rescrewable easily by the user, in particular for reasons of possible degradation of the dispensed product or change of use of the vial.

In addition, screwable sleeves have to allow a functional, unsightly clearance between the bottom of the sleeve and the shoulders of the body. Also, the screwing thereof on the filling lines is slow and therefore expensive. Moreover, the screwable sleeves must be screwed on the filling lines according to a very precise torque needing to be perfectly adhered to, to ensure the sealing thereof on the neck.

Using sleeves which are snap-fitted in the neck of the reservoir is also known. But, this solution as such is not satisfactory, as it does not assist the unlatching, which has the nature of discouraging the user to separate the components.

BRIEF SUMMARY OF THE INVENTION

The invention aims to improve the prior art by proposing, in particular, a system for quickly fixing a pump on the neck of a reservoir while making it possible for the intuitive and almost irreversible separation thereof at the end of recycling, and this by having an advantageous appearance and being simple to mount/dismount. The present invention aims to overcome the different disadvantages mentioned above, by means of a unit for dispensing a fluid product, conventionally including:

- a reservoir for packaging the product, constituted of a body surmounted by a neck defining an upper opening;
- a system for dispensing the product;
- a device for fixing the dispensing system to the reservoir. The fixing device consists of one single part having:
  - securing means on the neck of the reservoir actuated by an axial translation movement;
  - disconnection means with respect to the neck of the reservoir actuated by a rotation movement.

In other words, one single part integrates at least the securing means and the disconnection means. By "single" part, this means a part formed of one single unit, without a portion which can be removed from another, at least in the portion(s) integrating the securing means and the disconnection means. However, the part can be made of one single material, or formed of several materials, for example surmounted on one another. Likewise, it can also be formed of one single component, or several components, for example firmly inserted inside one another.

This fixing device makes it possible to mount the dispensing system on the reservoir by means of a single linear movement, which is simple to do on a production line.

Furthermore, this fixing device makes it possible to dismount the dispensing system with respect to the reservoir, following a simple rotational movement of the fixing device, carried out by the user when they want to separate the reservoir from the remainder of the elements of the dispensing unit with the aim of recycling, once all the product has been dispensed and that the reservoir is empty. This rotational movement is easy for the user. During this rotation, it is possible that some parts plastically deform, or break. This is one single dismounting, by keeping to the idea that it is not desirable that the user can easily remount the dispensing system on the reservoir, as explained above.

Finally, by using a single part, it is easier to use and stronger than the removable parts compared with one another.

According to an aspect of the invention, the single part can both fulfil the role of a sleeve and the role of a cap. It thus ensures a dual technical and aesthetic function.

According to this aspect of the invention, the fixing device makes it possible to maintain the dispensing system, in particular the pump, for example by snap-fitting, and to be mounted on the neck of the reservoir while ensuring a certain appearance from the outside, i.e. by concealing the technical elements of the dispensing system.

The dispensing unit is characterised mainly in that:

- the neck of the reservoir includes at least one radial projection, and has an annular edge around the upper opening;
- the fixing device includes a skirt having:
  - an annular ring, corresponding to the securing means, engaging with the annular edge of the neck for the snap-fitting of the fixing device on the neck of the reservoir;

at least one ramp, corresponding to the disconnection means, engaging with the radial projection for the unscrewing of the fixing device with respect to the neck of the reservoir.

The neck of the reservoir thus has a specific, relatively simple geometry, while the skirt of the fixing device has a complex geometry, contrary to the prior art documents, such as documents WO2011/117256, WO98/13293, EP1050478, or also WO2012/092989.

According to different embodiments of the invention, which can be taken together or separately:

the part forming the fixing device furthermore has fastening means of the dispensing system.

in a variant, the fastening means are returned on the part forming the fixing device.

the dispensing system includes a dispensing pump mounted in the reservoir.

the axial translation movement drives a snap-fitting of the fixing device on the neck of the reservoir. The snap-fitting is an easy mounting means which is easy to implement on a production line.

the rotation movement drives an unscrewing of the fixing device with respect to the neck of the reservoir. The unscrewing is a simple and intuitive manipulation for all users of dispensing units.

the disconnection means are intended to engage with the projection(s).

the fixing device includes a central funnel, in particular corresponding to the fastening means of the pump, inside which is inserted the dispensing system, in particular the pump, the funnel extending inside the skirt.

the fixing device includes indexing means of the position thereof with respect to the reservoir. Indeed, given that the fixing device also acts as a cap, it is essential that it is positioned and oriented correctly with respect to the reservoir, in particular if the unit has a specific shape. The geometry of the bottom portion of the dispensing unit, namely the reservoir, must correspond to the geometry of the top portion of the dispensing unit, namely the fixing device.

the indexing means consist of at least one slide provided on the fixing device, wherein is inserted the radial projection of the neck of the reservoir during the securing. Thus, the radial projection is used for both the indexing of the fixing device with respect to the reservoir during the mounting, and to the disconnection of the fixing device with respect to the neck of the reservoir. It fulfils two functions.

the slide is delimited by two side walls, extending in an axial direction over a length such as the radial projection is always located between the two side walls when the fixing device is snap-fitted in the neck of the reservoir. The side walls can be plastically deformed during the disconnection of the fixing device with respect to the reservoir.

the ramp is V-shaped. The radial projection slides along the ramp, following the rotational movement exerted by the user, from an upper end of the ramp, i.e. from a free end of one of the two V-shaped branches, towards a lower end of the ramp, i.e. towards the joining point between the two branches of the V. The radial projection is thus in contact with the ramp from a top point towards a bottom point, which drives the raising of the skirt, and therefore the fixing device, relative to the neck of the reservoir. The rotational movement is thus possible in both directions of rotation.

in a variant, the ramp has an inclined cross-section followed by an axially oriented cross-section. The rotational movement is thus only possible in one single direction of rotation.

the ramp has an edge against which slides the radial projection, this edge being chamfered. The edge is chamfered preferably towards the inside of the skirt. When the edge is chamfered on either side, i.e. towards the inside and also towards the outside of the skirt, it thus has a pointed profile.

the radial projection has a contact zone with the edge of the ramp, the contact zone being bevelled. This bevel makes it possible to more easily slide on the edge of the ramp, and makes it possible, in particular, to push on the ramp so as to displace the neck from the reservoir. It induces a radial force, which displaces the skirt radially, which also causes a displacement of the ring with respect to the edge of the neck, leading to an unclipping of the skirt during the raising thereof.

the fixing device includes a rounded peripheral wall, i.e. of a generally square shape with rounded corners.

preferably, the neck includes two, diametrically opposite radial projections, and the fixing device includes four slides arranged in the four corners of the rounded peripheral wall, the radial projections being engaged in two opposite slides.

the fixing device consists of a single moulded part.

The invention also relates to a method for mounting and dismounting a dispensing system with respect to a reservoir for packaging the fluid product using a dispensing unit such as described above, characterised in that it includes the following steps:

fastening the dispensing system, in particular the pump, to the fixing device;

carrying out an axial translation of the fixing device towards the neck of the reservoir until the snap-fitting of the fixing device with the neck of the reservoir;

carrying out a rotation of the fixing device with respect to the reservoir such that the radial projection slides over the ramp and drives an axial translational movement of the fixing device by moving it away from the neck of the reservoir, until the unlatching of the fixing device with the neck of the reservoir.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

In relation to the figures, below a dispensing unit intended to contain a fluid product in view of the dispensing thereof is described. In specific examples, the product can be a liquid or a cream, for example a perfume, for a cosmetic or pharmaceutical application.

Figure 2:
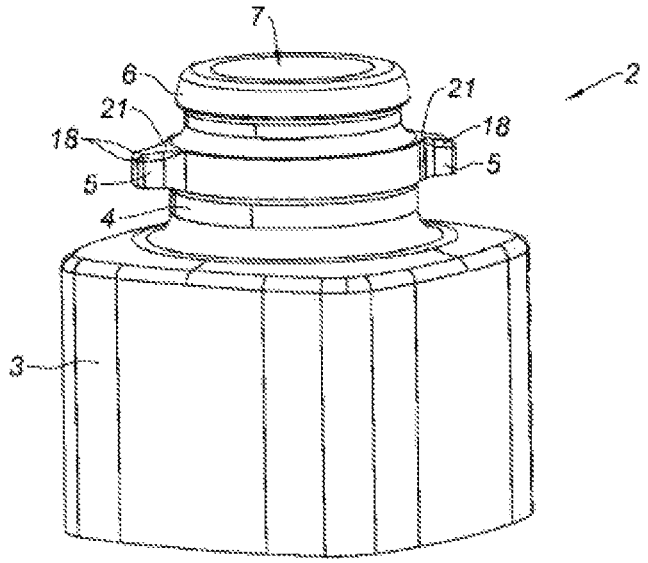
FIG. 2 shows, in perspective, a reservoir according to the invention.

The dispensing unit includes a reservoir 2, such as illustrated in FIG. 2, which can be formed of rigid material, in particular made of glass or made of plastic materials, to define a reservoir 2 for packaging the product.

This reservoir 2 consists of a body 3 surmounted by a neck 4 formed of one single part with the body 3, by defining an upper opening 7 for the reservoir 2.

Figure 8:
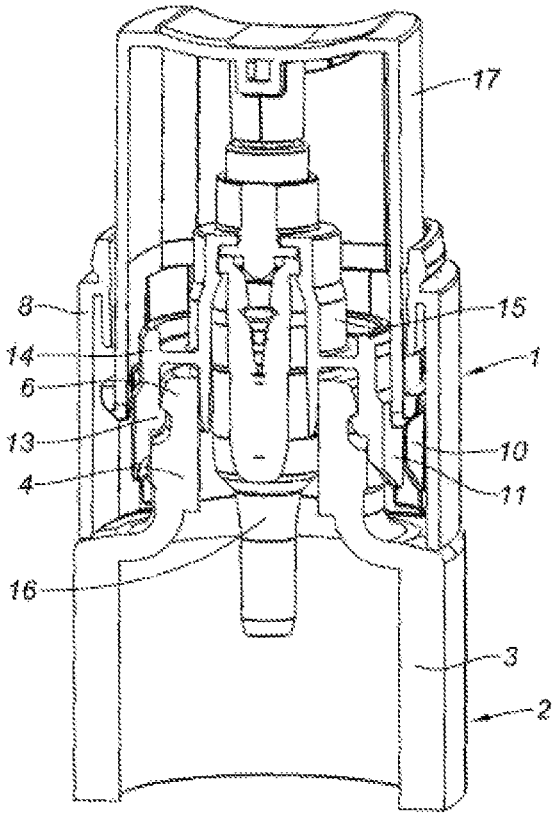
FIG. 8 is a cross-sectional, perspective view, of a dispensing unit according to the invention.

As illustrated in FIG. 8, this dispensing unit also includes a system for dispensing the product, for example, a pump 16 mounted in the upper opening 7 of the reservoir 2. This pump 16 engages with a pushbutton 17 equipped with a dispensing orifice. According to a known embodiment, the button 17 actuates, in reversible translation, a piston of the pump 16 to suction a product dose in the reservoir 2 and for the dispensing thereof.

To be able to position and fix this dispensing system on and/or in the reservoir 2, a fixing device 1 is provided, to which, here, the pump 16 is fastened, and which is fixed on the neck 4 of the reservoir 2. This fixing device 1 of the pump 16 is thus likened to a conventional sleeve.

This fixing device 1 preferably includes an external decorative peripheral wall 8 making it possible to conceal the functional portions thereof as well as the dispensing system, which is housed there, apart from the pushbutton 17 which itself must remain accessible by the user and therefore at least partially exposed. This fixing device 1 is thus likened to also to a conventional cap.

This fixing device 1 consists of a single part, for example, a plastic part obtained by moulding.

The fixing device 1 engages with the neck 4 of the reservoir 2 for the mounting thereof and the dismounting thereof.

In this case, for the mounting, the fixing device 1 is secured to the neck 4 of the reservoir 2 by snap-fitting, i.e. by an axial translational movement, simple to carry out on a production line. The fixing device 1 is thus "clicked" on the neck 4 of the reservoir 2.

For the dismounting, the fixing device 1 is disconnected from the neck 4 of the reservoir 2 by unscrewing, i.e. by a rotational movement, simple to carry out by a user, when the reservoir 2 is empty and that they want to recycle the reservoir 2, in particular if the latter is made of glass and that the dispensing system is made of plastic. It is thus necessary to be able to easily separate the reservoir 2 from the dispensing system.

Figure 1:
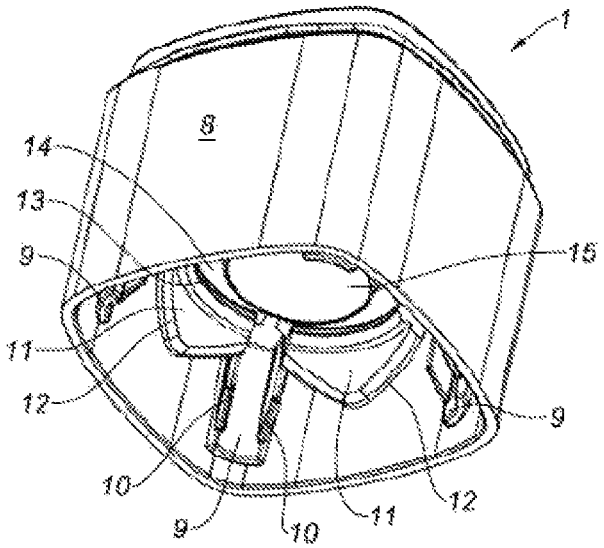
FIG. 1 shows, in perspective, a fixing device according to the invention.
Figure 3:
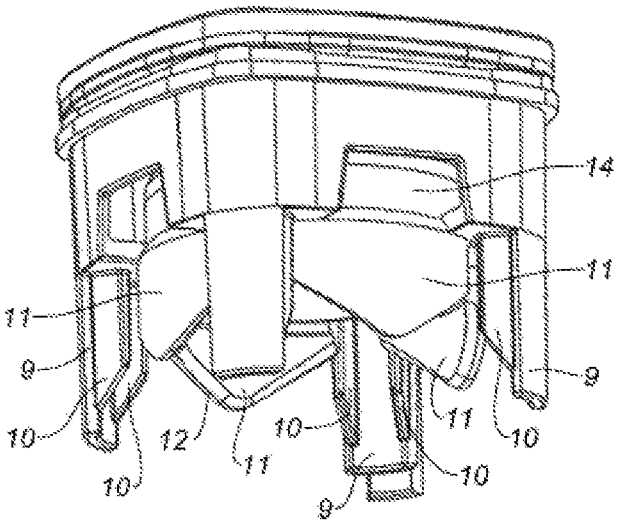
FIG. 3 partially represents the fixing device of FIG. 1.
Figure 4:
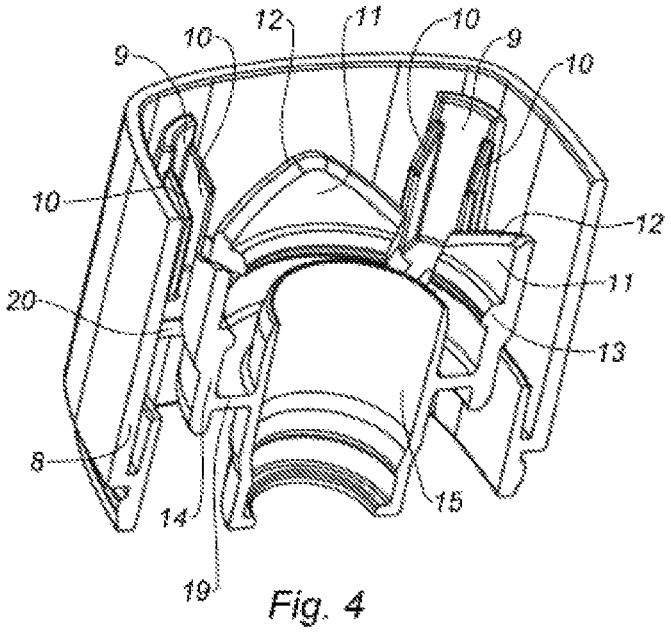
FIG. 4 is a cross-section view of the bottom of the fixing device according to FIGS. 1 and 3.

The fixing device 1 is shown in FIGS. 1, 3, 4, and has a central axis. It can moreover be noted, that in FIG. 3, as well as 5 to 7, the peripheral wall has not been shown in order to best see the inside of the fixing device.

It includes an internal skirt 14 with a cylindrical appearance, including an annular ring 13 directed towards the inside, and also includes a succession of ramps 11 at the level of the lower end thereof directed towards the neck 4 of the reservoir 2. These ramps 11 give a notched appearance to the skirt 14. Each ramp 11 is V-shaped. In the embodiment shown in the figures, there are four V-shaped ramps 11 distributed homogeneously over the perimeter of the skirt 14. For the purposes of the invention, a single ramp 11 is necessary.

These ramps 11 each have an edge 12 which consists of a first contact surface. Preferably, this edge 12 is chamfered towards the inside of the skirt 14. It thus has an end profile of a triangular appearance. It can also be chamfered on either side, giving it a pointed end profile.

Between each ramp 11 is located a slide 9 being deployed parallel to the central axis of the fixing device 1. These slides 9 consist of a bottom and of two side walls 10. The functions thereof will be explained below in the description. For the purposes of the invention, a single slide 9 is necessary.

The fixing device 1 also includes here a central funnel 15 extending inside of the skirt 14 and connected to the skirt 14 by a central ridge 19. This central funnel 15 houses the pump 16 of the dispensing system. The lower section of the funnel 15 is inserted inside the neck 4 of the reservoir 2, and has a thickness being reduced towards the end so as to be able to be flattened against the internal wall of the neck 4 of the reservoir 2, in order to achieve seal between the reservoir 2 and the fixing device 1.

Finally, the fixing device 1 includes an external peripheral wall 8 extending over the whole height of the part, in order to give it a uniform, external aesthetic appearance, and so that all the technical elements inside the fixing device 1 are concealed, in this case, the slides 9, the ramps 11, the skirt 14, the funnel 15, and the dispensing system. Preferably, this peripheral wall 8 can be rounded, the slides 9 thus being located in the four internal corners of this peripheral wall 8, and the ramps 11 being located in the vicinity of each side of the peripheral wall 8. This peripheral wall 8 can have any other shape, for example cylindrical, or square or rectangular, or triangular, etc.

The peripheral wall 8 is connected to the skirt 14 via peripheral ridges 20.

The pushbutton 17 is inserted between the peripheral wall 8 and the skirt 14 of the fixing device 1.

To be able to mount this fixing device 1 on the reservoir 2, the neck 4 of the reservoir 2 is provided with an annular edge 6 localised at the level of the free end thereof, and defining the upper opening 7. This annular edge 6 engages with the ring 13 provided in the skirt 14 of the fixing device 1. In this case, at the time of the mounting, the fixing device 1 is arranged above the neck 4 of the reservoir 2, then is pressed onto the neck 4 of the reservoir 2 until snap-fitting, i.e. until the ring 13 of the skirt 14 passes under the annular edge 6 of the neck 4 of the reservoir 2. This is therefore a quick, strong mounting. During the mounting, the neck 4 of the reservoir 2 is inserted between the skirt 14 and the funnel 15 of the fixing device 1.

To be able to mount and dismount the fixing device 1 with respect to the reservoir 2, the neck 4 of the reservoir 2 is provided with a radial projection 5 located between the annular edge 6 of the neck 4 and the body 3 of the reservoir 2. Preferably, and in the embodiment shown, there are two diametrically opposite radial projections 5.

During the mounting of the fixing device 1 on the neck 4, each radial projection 5 but first enter in a slide 9, which makes it possible to correctly orient the fixing device 1 with respect to the reservoir 2. Indeed, in the embodiment presented, the reservoir 2 has a rounded shape, just like the peripheral wall 8 of the fixing device 1. It is therefore necessary that the rounded peripheral wall 8 of the fixing device 1 can be aligned with the rounded peripheral wall of the body 3 of the reservoir 2. For this, the slides 9 and the radial projections 5 have a very precise positioning in the fixing device 1 and on the neck 4 of the reservoir 2. In this case, the radial projections 5 each extend in the direction of a corner of the rounded shape of the body 3 of the reservoir 2, the slides 9 themselves also being housed at the level of the corners of the rounded shape of the fixing device 1.

Once the fixing device 1 is correctly oriented with respect to the reservoir 2, the fixing device 1 continues the course thereof in the direction of the reservoir 2 and the radial projections 5 slide inside the slides 9 until the snap-fitting. Each radial projection 5 is retained inside the slide 9 surrounded by the two side walls 10 of the slide 9.

These slides 9 are thus used for the indexing of the fixing device 1 with respect to the reservoir 2, as well as for the guiding of the fixing device 1 with respect to the reservoir 2 during the mounting thereof.

During the dismounting of the fixing device 1 with respect to the neck 4 of the reservoir 2, the radial projections 5 engage with the ramps 11.

Figure 5:
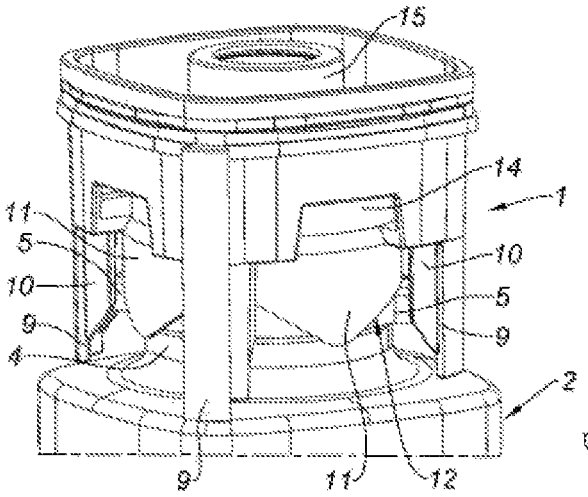
FIG. 5 partially shows the fixing device snap-fitted on the reservoir.

In FIG. 5, the fixing device 1 is snap-fitted on the neck 4 of the reservoir 2. Each radial projection 5 is located inserted inside a slide 9.

Figure 6:
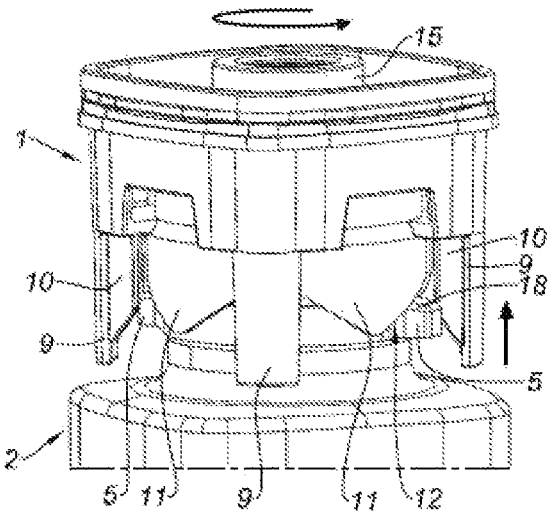
FIG. 6 partially shows the fixing device during unscrewing with respect to the reservoir.

In FIG. 6, the user starts to exert a rotational movement on the fixing device 1 so as to make it rotate with respect to the reservoir 2. During this movement, the radial projections 5 exit the slides 9 and come into contact with the ramps 11. During this phase, it is possible that the side walls 10 are elastically or plastically deformed.

The radial projections 5 have an upper surface 21 directed towards the top of the reservoir 2, i.e. directed towards the fixing device 1. At least one edge 18 of this upper surface 21 is bevelled. This bevelled edge 18 corresponds to a $2^{nd}$ contact surface, capable of sliding over the first contact surface corresponding to the chamfered edges 12 of the ramps 11, and more specifically, to the chamfered portion directed towards the inside of the skirt 14. Preferably, the three edges delimiting the upper surface 21 are bevelled.

Figure 7:
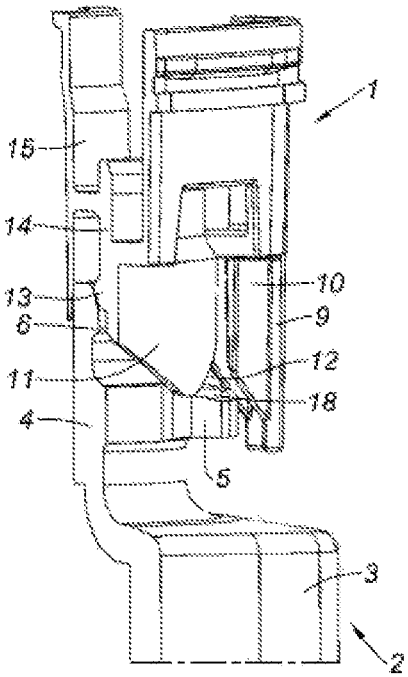
FIG. 7 partially shows the fixing device disconnected with respect to the reservoir.

Indeed, during the rotational movement, a bevelled edge 18 of the radial projection 5 contacts against the chamfered portion 12 (towards the inside of the skirt 14) of the ramp 11, in the vicinity of an upper end of the ramp 11, i.e. a top point of the ramp 11. In the course of the unscrewing, the bevelled edge 18 of the radial projection 5 slides along the chamfered portion 12 of the ramp 11 in the direction of a lower end of the ramp 11, i.e. a bottom point of the ramp 11, as illustrated in FIG. 7. The offset between the upper portion and the lower portion of the ramp 11 drives an axial translational movement of the fixing device 1 with respect to the reservoir 2, thus making it raise with respect to the reservoir 2.

Moreover, the contact between the bevelled edge 18 of the radial projection 5 and the chamfered portion 12 of the ramp 11 leads to an extension of the ramp 11 with respect to the neck 4 of the reservoir 2. Indeed, the contact between the different inclined portions tends to remove the ramp 11, i.e. to push it radially towards the outside. Thus, the internal diameter of the skirt 14 on which are formed the ramps 11, as well as the snap ring 13 increases, which favours the unclipping between the ring 13 of the skirt 14 and the annular edge 6 of the neck 4. FIG. 7 illustrates the fixing device 1 unlatched with respect to the neck 4 of the reservoir 2. During this phase, it is possible that the ramps plastically deform, or crack.

It must be noted, that the unlatching would also occur even if the radial projection 5 had no bevelled edge, and/or even if the ramp 11 had no chamfered edge. The rotation would thus be a little more "difficult" to obtain for the user.

Finally, the fixing device 1 has a helicoidal movement during the dismounting thereof, since the rotation movement induced by the user is combined with the axial translational movement induced by the contact between the radial projections 5 and the ramps 11.

The configurations shown in the figures cited are only possible, non-limiting examples of the invention which, on the contrary, include shape and design variants within the scope of a person skilled in the art.

Of note, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes", and/or "including," when used in this specification, specify the presence of stated features, integers, steps, operations, elements, and/or components, but do not preclude the presence or addition of one or more other features, integers, steps, operations, elements, components, and/or groups thereof.

As well, the corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

The invention claimed is:

1. A unit for dispensing a fluid product, comprising:

a reservoir for packaging the product, consisting of a body surmounted by a neck defining an upper opening;

a system for dispensing the product;

a device for fixing the dispensing system to the reservoir;

said fixing device consisting of one single part having:

securing means on the neck of the reservoir actuated by an axial translational movement;

disconnection means with respect to the neck of the reservoir actuated by a rotational movement;

the neck of the reservoir comprising at least one radial projection, and having an annular edge around the upper opening, the fixing device comprising a skirt having an annular ring, corresponding to said securing means engaging with said annular edge of the neck for the snap-fitting of the fixing device on the neck of the reservoir, wherein the skirt also has at least one ramp, corresponding to said disconnection means, engaging with said radial projection to unscrew the fixing device with respect to the neck of the reservoir.

2. The dispensing unit according to claim 1, wherein the dispensing system comprises a dispensing pump mounted in the reservoir.

3. The dispensing unit according to claim 1, wherein the axial translational movement leads to a snap-fitting of the fixing device on the neck of the reservoir.

4. The dispensing unit according to claim 1, wherein the rotational movement leads to an unscrewing of the fixing device with respect to the neck of the reservoir.

5. The dispensing unit according to claim 1, wherein the fixing device comprises a central funnel inside which is inserted said dispensing system, said funnel extending inside the skirt.

6. The dispensing unit according to claim 1, wherein the fixing device comprises means for indexing the position thereof with respect to the reservoir.

7. The dispensing unit according to claim 6, wherein said indexing means consist of at least one slide provided on the fixing device, wherein is inserted the radial projection of the neck of the reservoir during the securing.

8. The dispensing unit according to claim 7, wherein said slide is delimited by two side walls, extending in an axial direction over a length such that the radial projection is always located between the two side walls when the fixing device is snap-fitted in the neck 4 of the reservoir.

9. The dispensing unit according to claim 1, wherein the ramp is V-shaped.

10. The dispensing unit according to claim 1, wherein the ramp has an edge against which the radial projection slides, this edge being chamfered.

11. The dispensing unit according to claim 10, wherein the radial projection 5 has a contact zone with the edge of the ramp, said contact zone being bevelled.

12. The dispensing unit according to claim 1, wherein the fixing device consists of a single moulded part.

13. A method for mounting and dismounting a dispensing system with respect to a reservoir for packaging fluid product using a dispensing unit, the method comprising:

fastening the dispensing system to a fixing device for fixing the dispensing system to a reservoir for packaging the product, the dispensing system comprising:

the reservoir consisting of a body surmounted by a neck defining an upper opening;

a system for dispensing the product;

said fixing device consisting of one single part having:

securing means on the neck of the reservoir actuated by an axial translational movement;

disconnection means with respect to the neck of the reservoir actuated by a rotational movement;

the neck of the reservoir comprising at least one radial projection, and having an annular edge around the upper opening, the fixing device comprising a skirt having an annular ring, corresponding to said securing means engaging with said annular edge of the neck for the snap-fitting of the fixing device on the neck of the reservoir, wherein the skirt also has at least one ramp, corresponding to said disconnection means, engaging with said radial projection to unscrew the fixing device with respect to the neck of the reservoir;

carrying out an axial translation of the fixing device towards the neck of the reservoir until the snap-fitting of the fixing device with the neck of the reservoir;

carrying out a rotation of the fixing device with respect to the reservoir such that the radial projection slides over the ramp and drives an axial translation movement of the fixing device by moving it away from the neck of the reservoir, until the unlatching of the fixing device with the neck of the reservoir.

* * * * *